United States Patent [19]

Minamizono et al.

[11] 4,291,113

[45] Sep. 22, 1981

[54] METHOD FOR DISPERSING PHOTOGRAPHIC ADDITIVES

[75] Inventors: Junji Minamizono; Masakazu Yoneyama; Jun Sasaki, all of Minami-ashigara, Japan

[73] Assignee: Fuji Photo Film Co., Ltd., Kanagawa, Japan

[21] Appl. No.: 123,311

[22] Filed: Feb. 21, 1980

[30] Foreign Application Priority Data

Feb. 22, 1979 [JP] Japan ..... 54/20133

[51] Int. Cl.[3] ..... G03C 1/72

[52] U.S. Cl. ..... 430/202; 430/377; 430/449; 430/546; 430/629; 430/631

[58] Field of Search ..... 430/377, 493, 202, 546, 430/449, 629, 512, 631, 636, 637

[56] References Cited

U.S. PATENT DOCUMENTS

| | | | |
|---|---|---|---|
| 3,411,912 | 11/1968 | Dykstra | 430/627 |
| 3,495,986 | 2/1970 | Franco | 430/546 |
| 3,518,088 | 6/1970 | Dunn | 430/627 |
| 3,748,143 | 7/1973 | Bowman | 430/627 |
| 3,811,897 | 5/1974 | Babbit | 430/629 |
| 3,904,413 | 9/1975 | Mowrey | 430/546 |
| 4,198,478 | 4/1980 | Yoneyama | 430/546 |

*Primary Examiner*—Mary F. Downey

*Attorney, Agent, or Firm*—Sughrue, Mion, Zinn, Macpeak & Seas

[57] ABSTRACT

A method for dispersing an oil-soluble photographic additive into water or a hydrophilic colloid composition wherein an oil-soluble photographic additive is dispersed in water or a hydrophilic colloid composition in the presence of a polymer having a recurring unit represented by the following formula (I):

$$-(A)_x-\ -(B)_y- \qquad (I)$$

wherein A represents an ethylenically unsaturated monomer containing a sulfonic acid group; B represents a copolymerizable ethylenically unsaturated monomer; x is about 10 to 100 mol%; and y is about 0 to 90 mol%.

22 Claims, No Drawings

METHOD FOR DISPERSING PHOTOGRAPHIC ADDITIVES

BACKGROUND OF THE INVENTION

1. Field of the Invention

The present invention relates to a method of blending oil-soluble photographic additives into a hydrophilic colloid layer and, in particular, to a method of dispersing oil-soluble photographic additives into a hydrophilic colloid composition or into water.

2. Description of the Prior Art

In the manufacture of a photographic silver halide emulsion layer or other hydrophilic colloid coatings, one must often blend water-insoluble or sparingly soluble compounds (hereinafter referred to as "oil-soluble photographic additives") in such coatings. It may further be required that such additives which are insoluble in the hydrophilic colloid vehicle be uniformly dispersed in the form of extremely fine particles.

A typical color photographic light-sensitive material is based on a silver halide emulsion though other types of materials are known using various other kinds of light-sensitive components. Such silver halide color photographic materials comprise principally a support, a red-sensitive silver halide emulsion layer, a green-sensitive silver halide emulsion layer and a blue-sensitive silver halide emulsion layer, each provided on the support. Various arrangements and constructions of silver halide color photographic materials may be employed for different types of imaging processes including, for example, diffusion transfer color photography and silver dye bleach color photography. Mixed grain photographic products and multilayer products are also known.

A number of recent advances in color photographic technology have been brought about by the use of oil-soluble photographic additives, which are dissolved in substantially water-insoluble, high boiling organic solvents (for example, high boiling point organic solvents) and then dispersed into a hydrophilic colloid aqueous solution with the aid of an anionic surface active agent as an emulsifier. Such oil-soluble photographic additives include oil-soluble couplers, UV absorbing agents, fade preventing agents, antioxidants, dye precursors for color diffusion transfer, dye developers, etc.

Various methods are known for emulsifying and dispersing such oil-soluble photographic additives including methods disclosed in U.S. Pat. Nos. 2,739,888, 3,352,681, etc. for dispersing UV absorbing agents; the methods disclosed in U.S. Pat. Nos. 2,360,290, 2,728,659, 3,700,453, etc. for dispersing diffusion-resistant alkylhydroquinones used for preventing color fogging, color stain and color mixing.

Usually, anionic surfactants are used to disperse oil-soluble photographic additives. For example, the method set forth in U.S. Pat. No. 2,332,027 employs Gardinol WA (a sulfonated coconut fatty alcohol, Du Pont de Nemours & Co.) and triisopropylnaphthalenesulfonates. Japanese Pat. No. 428,191 discloses a method based on the use of water-soluble coupler containing a sulfo group or a carboxyl group together with a long-chain aliphatic group as an emulsifier. U.S. Pat. No. 3,676,141 describes a method relying upon a combination of an anionic surfactant containing a sulfonyl group and a nonionic surfactant containing an anhydrohexyl ester unit.

In designing and fabricating a color photographic product, the light-sensitive coatings have finite thicknesses and the presence of incorporated additives in the form of coarse particles in the coatings can cause light scattering and deteriorate the transparency of the finished product. Furthermore, the image sharpness as well as the graininess of the photograph can be remarkably deteriorated. In contrast, when a coupler is dispersed in fine particles, the surface area per unit of weight of the coupler increases which in turn increases the rate and the efficiency of dye development, thus bringing about an improvement in the covering power of the resulting color image.

Accordingly, it is important that the growth of coarse particles during storage of an emulsified product be prevented. Emulsified products prepared by either of the methods cited above exhibit insufficient storage stability. In particular, when they were stored for an extended period of time at low temperatures, or for 24 hours at 40° C., the growth of coarse particles is unavoidable.

SUMMARY OF THE INVENTION

A principal object of the present invention is to provide an emulsion containing oil-soluble photographic additive with excellent stability such that aggregation of particles and crystal deposits under severe storage conditions such as at low or high temperatures does not occur.

The above objects of the present invention have been achieved by dispersing an oil-soluble photographic additive in water or a hydrophilic colloid composition in the presence of a polymer having recurring units represented by the following general formula (I):

$$-(A)_x-\ -(B)_y- \qquad (I)$$

wherein A represents an ethylenically unsaturated monomer containing a sulfonic acid group; B represents a copolymerizable ethylenically unsaturated monomer; x represents 10 to 100 mol%; and y represents 0 to 90 mol%.

DETAILED DESCRIPTION OF THE INVENTION

The polymer represented by the formula (I) may be a random, block and/or graft copolymer as well as homopolymer of unit A and is preferably a random copolymer.

As the ethylenically unsaturated monomer containing a sulfonic acid group used in the present invention, a monomer represented by the following formula (II) is preferred.

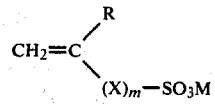

(II)

wherein R represents a hydrogen atom or a methyl group; m represents 0 or 1; M represents a cation (for example, a hydrogen atom, an alkali metal atom, an ammonium group, etc.); and X represents a divalent group, particularly an alkylene group having 1 to 4 carbon atoms, preferably 1 to 2 carbon atoms, an arylene group, an aralkylene group having 7 to 11 carbon atoms, —CO—NH—Y— or —COO—Y— (wherein Y represents an alkylene group having 1 to 6 carbon atoms or a phenylene group).

Specific examples of the ethylenically unsaturated monomer containing a sulfonic acid group represented by the general formula (II) are illustrated below:

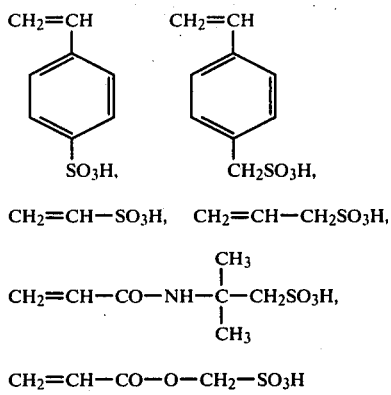

and water-soluble salts thereof (preferably a sodium salt, a potassium salt or an ammonium salt).

B represents a copolymerizable ethylenically unsaturated monomer other than the monomer for A, for example, an α-olefin having 2 to 8 carbon atoms, preferably 2 to 4 carbon atoms (such as ethylene, propylene, 1-butene, isobutene, etc.), styrene, α-methyl styrene, vinyl toluene, an ethylenically unsaturated ester of an aliphatic acid wherein the acid moiety has 3 to 8 and preferably 3 to 6 carbon atoms and the ester moiety has 1 to 8 and preferably 1 to 4 carbon atoms (such as vinyl acetate, allyl acetate, etc.), a monocarboxylic acid ester or dicarboxylic acid ester of an ethylenically unsaturated monomer wherein the acid moiety has 3 to 8 and preferably 3 to 6 carbon atoms and the ester moiety has 1 to 8 and preferably 1 to 4 carbon atoms (such as methyl methacrylate, ethyl acrylate, n-butyl acrylate, n-butyl methacrylate, n-octyl acrylate, benzyl acrylate, etc.), acrylonitrile, acrylic acid, methacrylic acid, acrylamide, or a diene having 4 to 8 and preferably 4 or 5 carbon atoms (such as butadiene, isoprene, etc.) and the like. Of these monomers, styrene, vinyl acetate, n-butyl acrylate, n-octyl acrylate, etc., are particularly preferred. Two or more monomers described above can be used together as B.

x is about 10 to 100 mol%, preferably about 25 to 90 mol% and y is about 0 to 90 mol%, preferably about 10 to 75 mol%.

The polymer containing a sulfonic acid group can be obtained by polymerizing the above-described monomer A containing a sulfonic acid group and a copolymerizable ethylenically unsaturated monomer B using a free radical initiator (for example, benzoyl peroxide).

Examples of solvents for polymerization reaction include, for example, N,N-dimethylformamide in the polymerization of styrene and potassium p-vinylbenzene sulfonate as described in R. H. Wiley et al., *J. Polymer Sci.*, Vol. 28, page 163 (1958), dimethylsulfoxide in the polymerization of sodium vinylsulfonate and vinyl acetate or styrene as described in W. Kern et al., *Makromol. Chem.*, Vol. 32, page 37 (1959), or water-methanol or water-ethanol in the polymerization of sodium vinylsulfonate and vinyl acetate as described in Japanese Patent Publication No. 30106/70, etc.

Specific examples of the polymers used in the present invention are illustrated below. The polymers include the recurring units described below in the ratio described below respectively, but the ratios of x and y are not limited to only those illustrated.

Compound (1)

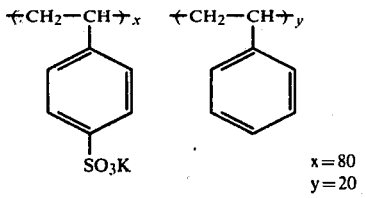

x=80
y=20

Compound (2)

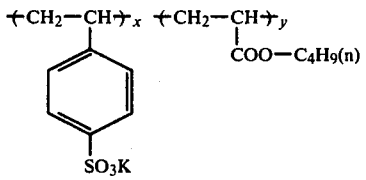

x=30
y=70

Compound (3)

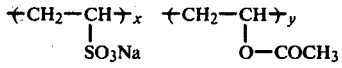

x=30
y=70

Compound (4)

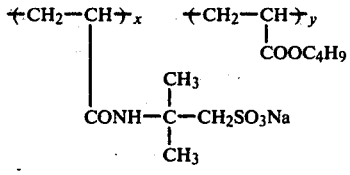

x=40
y=60

Compound (5)

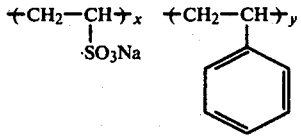

x=50
y=50

Compound (6)

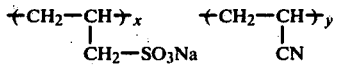

x=80
y=20

Compound (7)

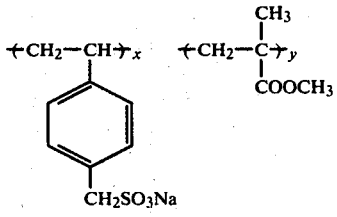

x=60
y=40

-continued

Compound (8)

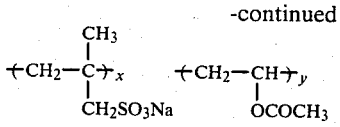

x=20
y=80

The polymers used in the present invention can be synthesized according to the methods described in U.S. Pat. Nos. 2,913,438, 2,859,191 and 2,601,256, *J. Polym. Sci.*, Vol. 28, page 163 (1958), *J. Am. Chem. Soc.*, Vol. 78, page 2171 (1956), *Makromol. Chem.*, Vol. 32, page 37 (1959), *J. Polym. Sci.*, Vol. 27, page 295 (1958), *ibid.*, Vol. 28, page 163 (1958), Japanese Patent Publication No. 30106/70 and Japanese Patent Application (OPI) No. 39119/78 (The term "OPI" as used herein refers to a "published unexamined Japanese patent application"), etc.

Specific examples for synthesis of the polymers used in the present invention are shown below.

SYNTHESIS EXAMPLE 1

Synthesis of Compound (1): Poly(potassium styrenesulfonate-co-styrene)

In a reaction vessel, 22.2 g of potassium styrenesulfonate, 10.4 g of styrene and 300 ml of N,N-dimethylformamide were placed. The mixture was heated at 90° C. with stirring under nitrogen atmosphere. A solution containing 0.5 g of benzoyl peroxide represented by the following formula:

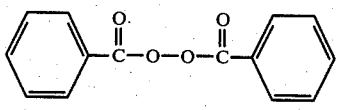

in 50 ml of N,N-dimethylformamide was added to the mixture. After stirring for 3 hours, the resulting precipitate was washed twice each with 50 ml of hot N,N-dimethylformamide, and then washed with 50 ml of ether. The product was dried under the pressure of 2 mmHg at 100° C. for 12 hours to obtain about 15 g of the hygroscopic polymer. The polymer was confirmed by elemental analysis to have the following composition:

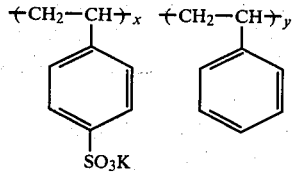

x:y = 80:20

SYNTHESIS EXAMPLE 2

Synthesis of Compound (3): Poly(sodium vinylsulfonate-co-vinyl acetate)

In a reaction vessel, 26 g of sodium vinylsulfonate, 17.2 g of vinyl acetate, 100 ml of distilled water and 100 ml of ethanol were placed. The mixture was heated at 50° C. with stirring under nitrogen atmosphere. A solution containing 0.1 g of ammonium persulfate in 10 ml of distilled water was added to the mixture and the polymerization was carried out for 20 hours. From the reaction product, water and ethanol were removed by distillation and the resultant solid was washed with a mixture of methanol and water (70:30 by volume %) to remove the unreacted sodium vinylsulfonate. The solid was dried under pressure of 2 mmHg at 100° C. for 12 hours to obtain about 35 g of the polymer. The polymer was confirmed by elemental analysis to have the following composition:

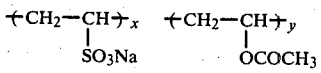

x:y = 30:70

SYNTHESIS EXAMPLE 3

Synthesis of Compound (8): Poly(sodium metallylsulfonate-co-vinyl acetate)

In a reaction vessel, 50 g of sodium metallylsulfonate, 300 g of vinyl acetate and 500 ml of methanol were placed. To the mixture, 1.2 g of $\alpha,\alpha'$-azodiisobutyronitrile (AIBN) represented by the following formula:

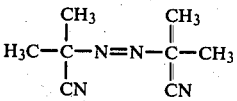

was added and the mixture was heated at 64° C. (reflux) with stirring under nitrogen atmosphere. After heating with stirring for 4 hours, the unreacted vinyl acetate and methanol were removed by distillation from the reaction product. The polymer thus obtained contains 6.8% of sulfur and confirmed to have the following composition:

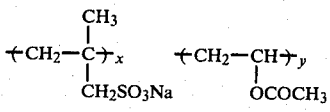

x:y = 20:80

The polymer used in the present invention can be added either to a solution of an oil-soluble photographic additive or to an aqueous colloid solution or to both of them depending on its solubility.

A suitable amount for the polymer used in the present invention can vary depending on the kind of the oil-soluble photographic additive dispersed, the kind and the amount of the dispersing solvent, and the type of the resulting color light-sensitive material, but it is typically about 0.5 to 20% by weight, preferably about 1 to 10% by weight based on the weight of the oil-soluble photographic additive.

The polymer used in the present invention can be used not only alone but also together with other anionic surface active agents and/or nonionic surface active agents.

The anionic surface active agents preferably used in the practice of the present invention have in their molecular structure a hydrophobic moiety containing 8 to 30 carbon atoms and an —$SO_3M$ or —$OSO_3M$ moiety wherein M has the same meaning as defined in the formula (I) above. Preferred anionic surface active agents are alkylsulfuric acid esters, alkylsulfonates, alkylbenzenesulfonic acids, sulfosuccinic acids (for example, anionic surface active agent A-8 listed hereinafter) and naphthalenesulfonic acids (for example, anionic surface active agent A-11 listed hereinafter). Hereinafter, such anionic surfactants will be referred to as "sulfonic acid type" and "sulfate type" anionic surfactants, respectively. These surfactants are described in *Synthesis and Application of Surface Active Agents,* authored by R. Oda and K. Teramura, published by Maki Publishing Co., and *Surface Active Agents,* authored by A. W. Perry (Interscience Publications Inc., New York).

Examples of the above-cited anionic surface active agents are listed below.

| | |
|---|---|
| A-1 | $C_{12}H_{25}OSO_3Na$ |
| A-2 | $C_{14}H_{29}OSO_3Na$ |
| A-3 | Sulfonated oil |
| A-4 | $C_{12}H_{25}CONHCH_2CH_2OSO_3Na$ |
| A-5 | $C_{12}H_{25}SO_3Na$ |
| A-6 | $C_{14}H_{29}SO_3Na$ |
| A-7 | 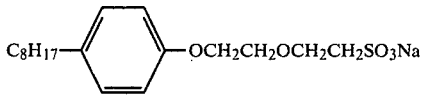 |
| A-8 | $NaO_3S-CH.COOC_8H_{17}$ <br> $\quad\quad\quad

in conjunction with oil-soluble additives other than these.
Yellow Dye Forming Couplers:
Y-1
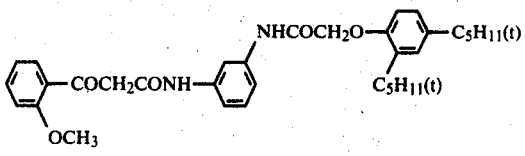
Y-2
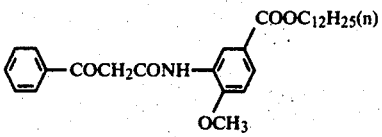
Y-3
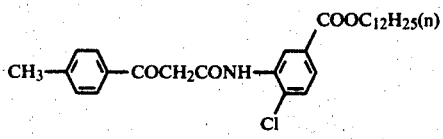
Y-4
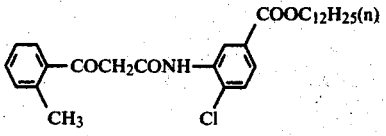
-continued
Yellow Dye Forming Couplers:
Y-5
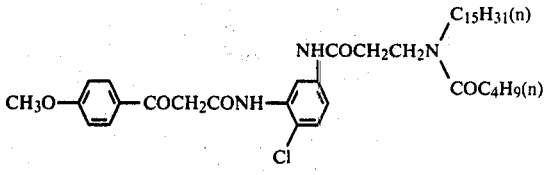
Y-6
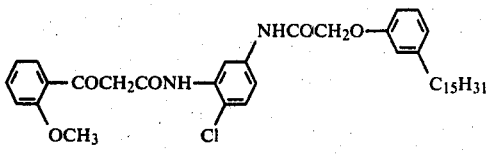
Y-7
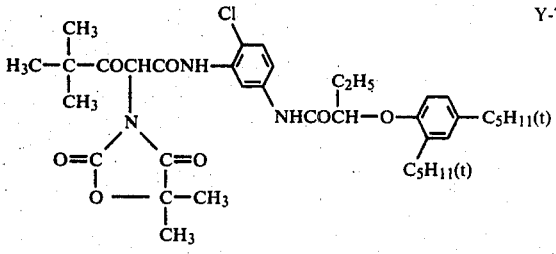
Magenta Dye Forming Couplers:
M-1
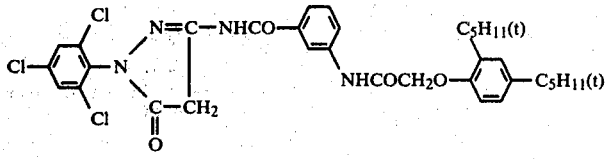
M-2
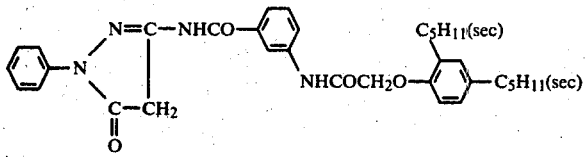
M-3
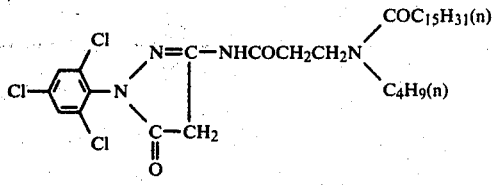
M-4
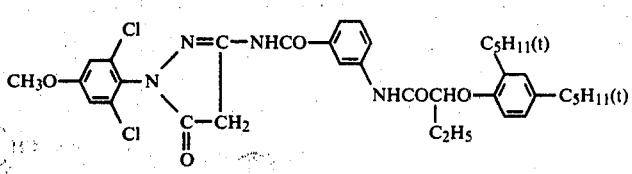
M-5
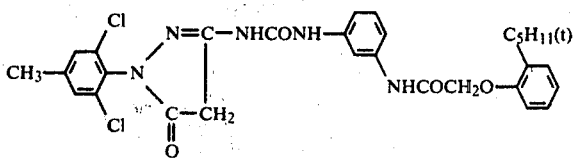

-continued
Magenta Dye Forming Couplers:
M-6
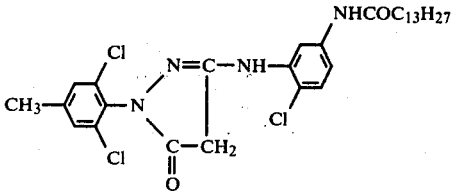
Cyan Dye Forming Couplers:
C-1
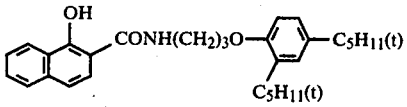
C-2
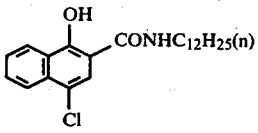
C-3
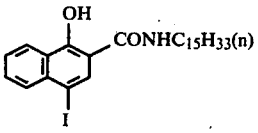
C-4
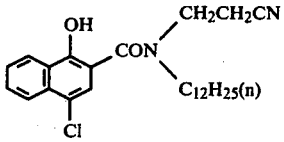
-continued
Cyan Dye Forming Couplers:
C-5
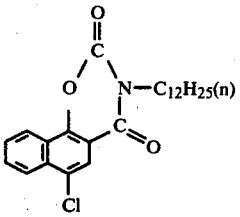
C-6
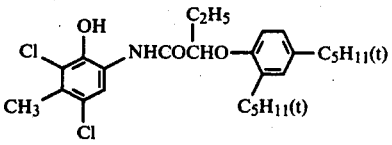
Mask Forming Colored Couplers:
L-1
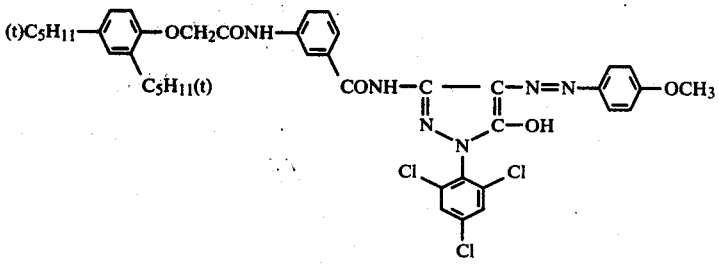
L-2
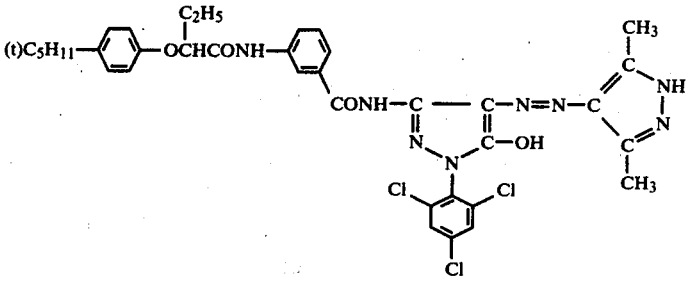
L-3
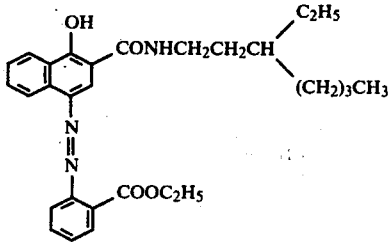

-continued

L-4

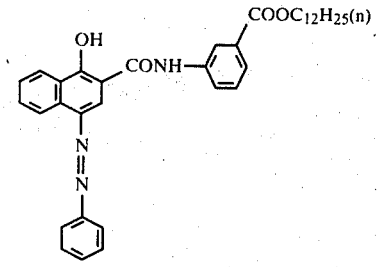

DIR Couplers (Development Inhibitor Releasing Coupler):

N-1

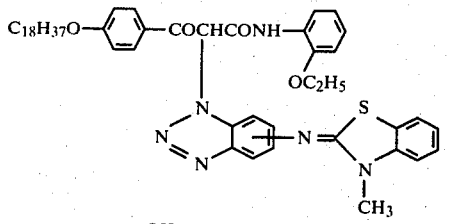

N-2

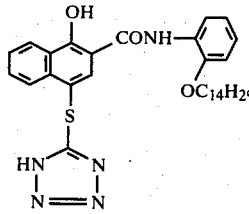

N-3

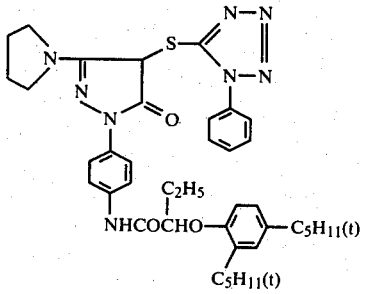

Oil-soluble UV absorbing agents which can be used in conjunction with the present invention include those set forth in, for example, Japanese Patent Publication No. 21687/67 and U.S. Pat. Nos. 3,533,794, 3,794,493 and 3,707,375, etc.

Several exemplary compounds of oil-soluble UV absorbing agents are illustrated below.

U-1

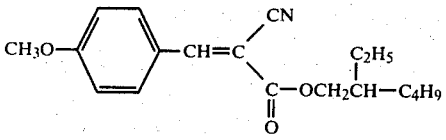

U-2

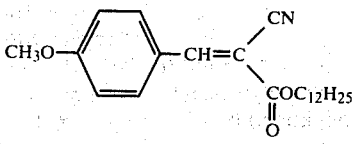

-continued

U-3

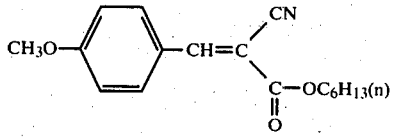

U-4

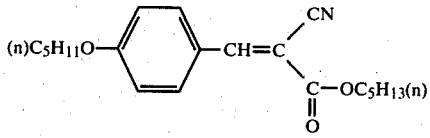

U-5

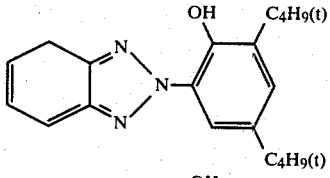

U-6

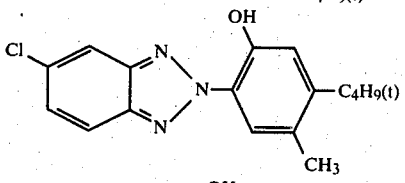

U-7

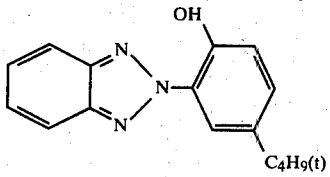

The method of the present invention can also be applied to oil-soluble antioxidants such as are set forth in U.S. Pat. Nos. 2,336,327, 2,728,659, 2,835,579 and 3,700,453, etc.

Some oil-soluble antioxidants are exemplified below:

AO-1

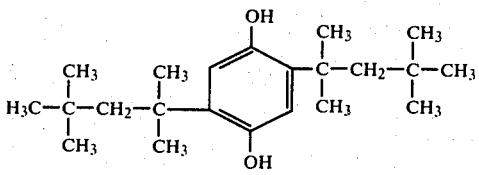

AO-2

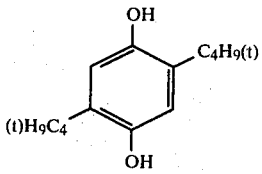

Fade preventing agents for the finished dye image to which the present invention is applicable include those set forth in, for example, Belgian Pat. No. 777,487, German Pat. No. 1,547,684, German Patent Application (OLS) No. 2,146,668, etc.

Oil-soluble dye precursors to which the present invention is applicable and which can be employed in diffusion transfer color photographic elements include, for example, dye releasing redox compounds set forth in Japanese Patent Application (OPI) No. 11424/74 and U.S. Pat. Nos. 4,076,529, 3,932,381, 3,954,476, 3,942,987, 4,013,635 and 4,055,428, etc.

Examples are shown below.

DR-1

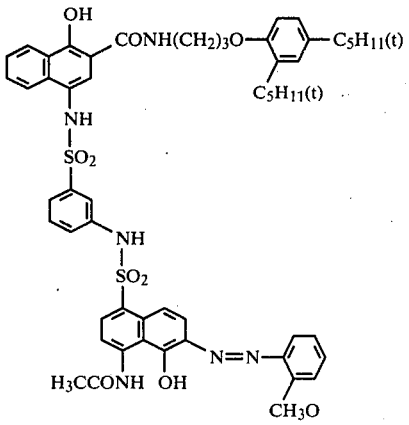

DR-2

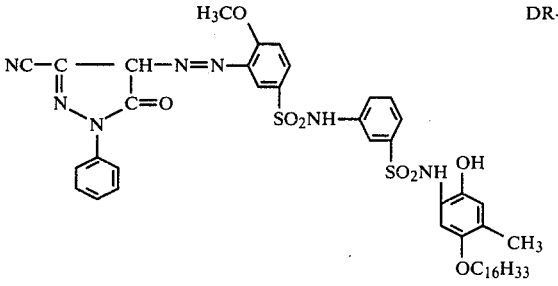

DR-3

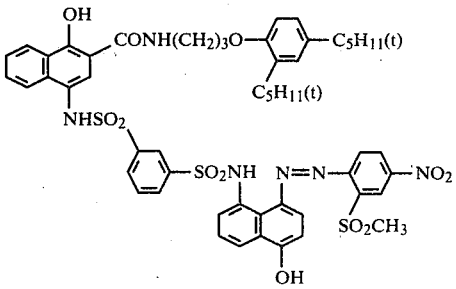

DR-4

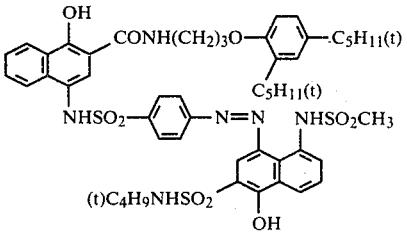

-continued

DR-5

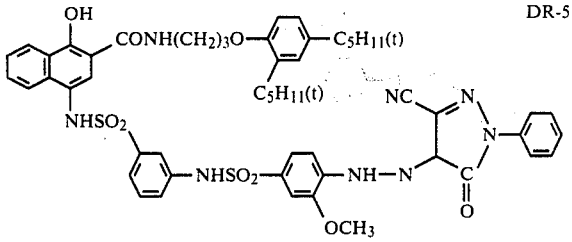

Furthermore, the present invention can be used in conjunction with compounds releasing dyes upon coupling reaction as set forth in British Pat. Nos. 840,731, 904,364, 904,365 and 1,038,331, U.S. Pat. Nos. 3,227,551 and 3,327,554, etc., those compounds that can provide dyestuffs upon coupling reaction and those are set forth in British Pat. Nos. 840,731 and 904,364, U.S. Pat. Nos. 3,227,551 and 3,227,554, etc., and dye developers set forth in U.S. Pat. Nos. 3,415,644, 3,415,645, 3,415,646, 3,594,164 and 3,594,165.

In practicing the method of the present invention, the oil-soluble photographic additive must be melted or fused by heat or dissolved in an organic solvent prior to emulsification. Only additives that have a melting point below about 90° C. can be emulsified directly through thermal fusion.

The organic solvents used to finely disperse the oil-soluble photographic additive in the aqueous medium (to provide an oily phase) are preferably substantially immiscible in water and have a boiling point of at least 190° C. at atmospheric pressure. Such high-boiling organic solvents are described, for example, in U.S. Pat. Nos. 2,322,027, 2,533,514 and 2,835,579, Japanese Patent Publication No. 23233/71, U.S. Pat. No. 3,287,134, British Pat. No. 958,441, Japanese Patent Application (OPI) No. 1031/72, British Pat. No. 1,222,753, U.S. Pat. No. 3,936,303, Japanese Patent Application (OPI) Nos. 26037/76 and 82078/75, U.S. Pat. Nos. 2,353,262, 2,852,383, 3,554,755, 3,676,137, 3,676,142, 3,700,454, 3,748,141, 3,837,863, German Patent Application (OLS) No. 2,538,889, Japanese Patent Application (OPI) Nos. 27921/76, 27922/76, 26035/76, 26036/76 and 62632/75, Japanese Patent Publication No. 29461/74, U.S. Pat. No. 3,936,303, etc.

High-boiling organic solvents advantageously used in the present invention include esters (e.g., phthalates, phosphates, citrates, benzoates, fatty acid esters, carbonates, etc.), amides (e.g., fatty acid amides, sulfonamides, etc.), ethers (e.g., allyl ethers, etc.), alcohols, paraffins, etc. Most preferably used are high boiling organic solvents, for example, phthalate esters (e.g., dibutyl phthalate, dihexyl phthalate, diheptyl phthalate, dioctyl phthalate, dinonyl phthalate, didecyl phthalate, butylphthalylbutyl glycolate, dibutyl monochlorophthalate, etc.), phosphoric acid esters (e.g., tricresyl phosphate, trixylelyl phosphate, tris(isopropylphenyl) phosphate, tributyl phosphate, trihexyl phosphate, trioctyl phosphate, trinonyl phosphate, tridecyl phosphate, trioleyl phosphate, tris(butoxyethyl) phosphate, tris(chloroethyl) phosphate, tris(dichloropropyl) phosphate, etc.), citric acid esters (e.g., o-acetyltriethyl (or butyl, hexyl, octyl, nonyl, decyl) citrate, triethyl (or butyl, hexyl, octyl, nonyl, decyl, tridecyl) citrate, etc.), benzoic acid esters (e.g., butyl (or hexyl, heptyl, octyl, nonyl, decyl, dodecyl, tridecyl, tetradecyl, hexadecyl, octadecyl, oleyl, etc.) benzoate, pentyl o-methylbenzoate, decyl p-methylbenzoate, octyl o-chlorobenzoate, lauryl p-chlorobenzoate, propyl 2,4-dichlorobenzoate, octyl 2,4-dichlorobenzoate, stearyl 2,4-dichlorobenzoate, oleyl 2,4-dichlorobenzoate, octyl p-methoxybenzoate, etc.), fatty acid esters (e.g., hexadecyl milistate, dibutoxyethyl succinate, dioctyl adipate, dioctyl azelate, decamethylene-1,10-diol diacetate, triacetin, tributin, benzyl caprate, pentaerythritol tetracaproate, isosorbide dicaprylate, etc.), amides (e.g., N,N-dimethyllauramide, N,N-diethylcaprylamide, N-butylbenzenesulfonamide, etc.), trioctyl trimellitate, chlorinated paraffin, etc.

Occasionally in the practice of the present invention, it is advantageous to employ, together with a high boiling solvent cited above, a low boiling point auxiliary solvent (having a boiling point not exceeding 130° C.) or a high boiling water-miscible solvent to dissolve the oil-soluble photographic additive. Such water-miscible high boiling point solvents or volatile solvents include, for example, propylene carbonate, ethyl acetate, butyl acetate, ethyl propionate, sec-butyl alcohol, tetrahydrofuran, cyclohexanone, dimethylformamide, diethyl sulfoxide, methyl cellosolve, carbinol, etc.

The emulsifying apparatus used to practice the present invention should preferably be such as to be able to impart a large stress on the liquid to be treated, or to transmit ultrasonic energy of high intensity. Suitable apparatuses include a colloid mill, a homogenizer, a microporous emulsifier, a liquid siren, an electromagnetic strain type ultrasonic generator, and an emulsifier provided with Pollmann's whistle.

The hydrophilic colloid in the hydrophilic colloid composition used in the present invention is a binder or protective colloid for the usual silver halide photographic light-sensitive materials.

In practicing the present invention, one can remove the low boiling solvents employed in order to improve the stability of the resulting emulsion.

Gelatin is most preferably used as binder or protective colloid in the present invention, though, of course, other hydrophilic colloids may also be used. Other suitable hydrophilic materials include, for example, gelatin derivatives, graft copolymers comprising gelatin and other polymeric materials, albumin, casein and other forms of protein, cellulose derivatives such as hydroxyethyl cellulose, carboxymethyl cellulose, the sulfuric acid ester of cellulose, etc., carbohydrate derivatives such as sodium alginate, starch and its derivatives, etc., various synthetic polymer materials such as poly(vinyl alcohol), partially acetalized poly(vinyl alcohol), poly-N-vinylpyrrolidone, poly(acrylic acid), poly(methacrylic acid), polyacrylamide, polyvinylimidazole, polyvinylpyrazole, etc., and copolymers consisting of the monomer unit contained in the above cited polymers.

Among various types of gelatin, one can use alkaline processed gelatin, acid processed gelatin, the hydrolyzed product therefrom, or the peptized product therefrom with an enzyme. Suitable gelatin derivatives include the reaction products obtained by subjecting gelatin to reactions with a number of reagents such as acid halide, such anhydride, isocyanate, bromoacetic acid, alkane sultone, vinylsulfonamide, maleinimide, polyalkylene oxide, epoxide, etc. Reference can be made to U.S. Pat. Nos. 2,614,928, 3,132,945, 3,186,846 and 3,312,553, British Pat. Nos. 861,414, 1,033,189 and 1,005,784, Japanese Patent Publication No. 26845/67, etc.

Representative hydrophilic synthetic polymeric materials include those described in, for example, German Patent Application (OLS) No. 2,312,708, U.S. Pat. Nos. 3,620,751 and 3,879,205, Japanese Patent Publication No. 7561/68.

The prominent features and effects of the present invention will now be explained in more detail.

By practicing the present invention, one can disperse finely and very stably oil-soluble photographic additives such as an oil-soluble coupler, an oil-soluble UV absorbing agent, an oil-soluble antioxidant and an oil-soluble dye precursor without deteriorating the photographic performance of the final product and also without the tendency of particle agglomeration or separation of recrystallized deposits. Further, by using the dispersion prepared in accordance with the present invention, one can produce a photographic light-sensitive product which precipitates no crystalline product after the coating and drying of the dispersion.

Most of the emulsifying agents conventionally used in the photographic art are generally more or less hygroscopic and tend to deteriorate the physical properties of the film on the surface of the product. This fact leads to an unacceptably sticky surface and an increase in the amount of the emulsifier used. By contrast, the combination of the emulsifiers characterizing the present invention exhibits a high degree of emulsifying capability, and a relatively small amount is required, thus the above cited drawbacks are avoided.

The present invention is illustrated in greater detail below by reference to the following Examples.

EXAMPLE 1

20 g of the cyan coupler (C-6) described hereinbefore was dissolved into a mixture consisting of 15 g di-n-butyl phthalate and 30 g ethyl acetate with heating at 65° C. The resulting coupler solution was added with stirring to 250 g of a 10% gelatin aqueous solution containing 1 g of Compound (1) according to the present invention at 50° C. The mixture was then agitated by means of a high speed homogenizer (15,000 rotation) for 6 minutes to prepare an emulsion.

When the emulsion had stood at 40° C. for 3 days, the precipitation of crystalline coupler was not observed.

With respect to an emulsion which was prepared in the same manner as described above except using 1 g of sodium dodecylbenzenesulfonate in place of Compound (1) for the purpose of comparison, a large amount of precipitation of crystalline coupler was observed after storage at 40° C. for 24 hours.

As is apparent from these results, Compound (1) according to the present invention exhibits the superior property for inhibiting the precipitation of crystalline coupler in an emulsion.

EXAMPLE 2

20 g of the magenta coupler (M-3) described hereinbefore was dissolved into a mixture consisting of 5 g of di-n-butyl phthalate and 40 g of ethyl acetate with heating. The resulting solution was added with stirring to 250 g of a 10% gelatin aqueous solution containing 1 g of Compound (5) according to the present invention at 50° C. The mixture was agitated by means of the same apparatus as in Example 1 for 6 minutes to prepare an emulsion. The resulting emulsion was allowed to stand in the same manner as in Example 1 and the precipitation of crystalline coupler was not observed at all.

With respect to an emulsion which was prepared in the same manner as described above except using 1 g of sodium dodecylbenzenesulfonate in place of Compound (5) for the purpose of comparison, a large amount of precipitation of crystalline coupler was observed after storage at 40° C. for 12 hours.

In this example, it is illustrated that Compound (5) according to the present invention has a superior effect for inhibiting the precipitation of crystalline coupler.

EXAMPLE 3

13 g of the UV absorbing agent (U-5) described hereinbefore was dissolved into a mixture of 5 g of tricresyl phosphate and 20 g of ethylacetate with heating at 65° C. The resulting solution was added to 150 g of a 10% gelatin aqueous solution containing 0.7 g of Compound (3) according to the present invention at 50° C. The mixture was agitated by means of the same apparatus as in Example 1 to prepare an emulsion. The resulting emulsion was allowed to stand at 40° C. for 1 week and the precipitation of crystalline UV absorbing agent was not observed.

With respect to an emulsion which was prepared in the same manner as described above except using 0.7 g of sodium dioctylsulfosuccinate in place of Compound (3) for the purpose of comparison, a large amount of precipitation of crystalline UV absorbing agent was observed after storage at 40° C. for 48 hours.

In this example, it is illustrated that Compound (3) according to the present invention has a superior effect for inhibiting the precipitation of crystalline UV absorbing agent.

EXAMPLE 4

20 g of the cyan coupler (C-1) described hereinbefore was dissolved into a mixture of 5 g of tricresyl phosphate and 20 g of ethyl acetate with heating at 65° C. The resulting solution was added to 200 g of a gelatin aqueous solution containing 0.6 g of Compound (2) according to the present invention and 0.4 g of sodium dodecylbenzenesulfonate at 50° C. with stirring. The mixture was agitated by means of a homogenizer to prepare an emulsion. The resulting emulsion was subjected to stand at 40° C. for 3 days as in Example 1, and the precipitation of crystalline coupler and the separation of tricresyl phosphate oil droplet were not observed at all.

With respect to an emulsion which was prepared in the same manner as described above except using 0.6 g of sodium dodecylbenzenesulfonate in place of Compound (2) according to the present invention for the purpose of comparison, a large amount of the precipitation of crystalline coupler was observed after the storage for 24 hours.

It is apparent from these results that the compound according to the present invention exhibits the effect of inhibiting the precipitation of crystalline coupler when the compound is used together with a surface active agent other than the present invention.

EXAMPLE 5

20 g of the yellow coupler (Y-2) described hereinbefore was dissolved in a mixture of 15 g of n-dibutyl phthalate and 60 g of ethyl acetate with heating at 65° C. The resulting solution was added to a gelatin aqueous solution containing 1.2 g of Compound (4) according to the present invention, 0.8 g of sodium dioctylsulfosuccinate and 3 g of lecithin extracted from soybean at 50° C. The mixture was agitated by means of a homogenizer to prepare an emulsion. The ethyl acetate was removed in vacuo from the emulsion. The mean particle size of the emulsion was less than 0.01 micron and the precipitation of crystalline coupler was not observed after the storage of 40° C. for 7 days.

With respect to an emulsion which was prepared in the same manner as described above except using 1.2 g of sodium dioctylsulfosuccinate in place of Compound (4) according to the present invention, a large amount of the precipitation of crystalline coupler was observed after the storage for 3 days.

While the invention has been described in detail and with reference to specific embodiments thereof, it will be apparent to one skilled in the art that various changes and modifications can be made within therein without departing from the spirit and scope thereof.

What is claimed is:

1. A method for dispersing an oil-soluble photographic additive into water or a hydrophilic colloid composition wherein an oil-soluble photographic additive is dispersed in water or a hydrophilic colloid composition in the presence of a polymer having a recurring unit represented by the following general formula (I):

$$-(A)_x-o-(B)_y- \quad \text{(I)}$$

wherein A represents a monomer unit of the formula (II):

$$-CH_2-\underset{\underset{(X)_m-SO_3M}{|}}{\overset{\overset{R}{|}}{C}}- \quad \text{(II)}$$

wherein R represents a hydrogen atom or a methyl group; m represents 0 or 1; M represents a cation; and X represents an alkylene group having 1 to 4 carbon atoms, an arylene group, an aralkylene group having 7 to 11 carbon atoms or a —CO—NH—Y— group where Y is an alkylene group having 1 to 6 carbon atoms or a phenylene group; B represents a copolymerizable ethylenically unsaturated monomer; x is about 10 to 100 mol%; and y is about 0 to 90 mol%.

2. The method of claim 1, wherein said additive is an oil-soluble photographic color coupler.

3. The method of claim 1, wherein said additive is an oil-soluble antioxidant.

4. The method of claim 1, wherein said additive is a dye precursor for a color diffusion transfer process.

5. The method of claim 1, wherein said additive is an oil-soluble UV absorbing agent.

6. The method of claim 1, wherein an anionic surface active agent and/or a nonionic surface active agent is also present.

7. The method of claim 6, wherein said anionic surface active agent is an anionic surface active agent having in its molecular structure a hydrophobic moiety containing from 8 to 30 carbon atoms and an $-SO_3M$ or $-OSO_3M$ group wherein M represents an alkali metal atom or an ammonium group.

8. The method of claim 1, wherein said monomer forming B is styrene, vinyl acetate, n-butyl acrylate or n-octyl acrylate.

9. The method of claim 1, wherein said additive is dissolved in an organic solvent and dispersed in a hydrophilic colloid.

10. The method of claim 9, wherein said solvent is substantially immiscible in water and has a boiling point of at least 190° C. at atmospheric pressure.

11. The method of claim 9, wherein in addition to said high boiling solvent a solvent having a boiling point less than 130° C. is present.

12. In a method for preparing a photographic material, wherein an oil-soluble photographic additive is dispersed in water or a hydrophilic colloid composition the improvement which comprises dispersing said oil-soluble photographic additive in water or a hydrophilic colloid composition in the presence of a polymer having a recurring unit represented by the following general formula (I):

$$-(A)_x-o-(B)_y- \quad (I)$$

wherein A represents a monomer unit of the formula (II):

$$-CH_2-\underset{(X)_m-SO_3M}{\overset{R}{C}}- \quad (II)$$

wherein R represents a hydrogen atom or a methyl group; m represents 0 or 1; M represents a cation; and X represents an alkylene group having 1 to 4 carbon atoms, an arylene group, an aralkylene group having 7 to 11 carbon atoms or a —CO—NH—Y— group where Y is an alkylene group having 1 to 6 carbon atoms or a phenylene group; B represents a copolymerizable ethylenically unsaturated monomer; x is about 10 to 100 mol%; and y is about 0 to 90 mol%.

13. The method of claim 12, wherein said additive is an oil-soluble photographic color coupler.

14. The method of claim 12, wherein said additive is an oil-soluble antioxidant.

15. The method of claim 12, wherein said additive is a dye precursor for a color diffusion transfer process.

16. The method of claim 12, wherein said additive is an oil-soluble UV absorbing agent.

17. The method of claim 12, wherein an anionic surface active agent and/or a nonionic surface active agent is also present.

18. The method of claim 17, wherein said anionic surface active agent is an anionic surface active agent having in its molecular structure a hydrophobic moiety containing from 8 to 30 carbon atoms and an $-SO_3M$ or $-OSO_3M$ group wherein M represents an alkali metal atom or an ammonium group.

19. The method of claim 12, wherein said monomer forming B is styrene, vinyl acetate, n-butyl acrylate or n-octyl acrylate.

20. The method of claim 12, wherein said additive is dissolved in an organic solvent and dispersed in a hydrophilic colloid.

21. The method of claim 20, wherein said solvent is substantially immiscible in water and has a boiling point of at least 190° C. at atmospheric pressure.

22. The method of claim 20, wherein in addition to said high boiling solvent a solvent having a boiling point less than 130° C. in present.

* * * * *